US005979715A

United States Patent [19]

Emrick

[11] Patent Number: 5,979,715

[45] Date of Patent: Nov. 9, 1999

[54] SPRAY CONTAINER HAVING AN EXTENDABLE FRUSTRO-CONICAL WEIGHT COUPLED TO THE SIPHONING TUBE

[76] Inventor: Kelly Wayne Emrick, 1270 Smoke Rise Dr., Mobile, Ala. 36695

[21] Appl. No.: 09/048,968

[22] Filed: Mar. 26, 1998

[51] Int. Cl.[6] ..... B67D 5/60

[52] U.S. Cl. ..... 222/464.4; 222/211; 222/382

[58] Field of Search ..... 222/211, 382, 222/464.4, 464.3

[56] References Cited

U.S. PATENT DOCUMENTS

| | | | |
|---|---|---|---|
| 1,293,850 | 2/1919 | Mathis | 222/464.4 |
| 1,719,277 | 7/1929 | Parker | 222/464.3 |
| 2,530,583 | 11/1950 | Nurkiewicz | 222/464.4 |
| 3,547,296 | 12/1970 | Greenberg | 215/11 |
| 3,580,430 | 5/1971 | Angele | 222/394 |
| 4,273,272 | 6/1981 | Blanc | 222/464 |
| 4,830,235 | 5/1989 | Miller | 222/464 |
| 4,940,152 | 7/1990 | Lin | 215/11.5 |
| 5,195,664 | 3/1993 | Rhea | 222/464.4 |
| 5,215,227 | 6/1993 | Farner | 222/175 |
| 5,636,770 | 6/1997 | Hachinohe | 222/402.1 |

*Primary Examiner*—Andres Kashnikow
*Assistant Examiner*—Keats Quinalty
*Attorney, Agent, or Firm*—Joseph N. Breaux

[57] ABSTRACT

A spray container having an extendable frustro-conical weight coupled to the free end of a siphoning tube. The frustro-conical contour and the extendable properties of the extendable frustro-conical weight allows the extendable frustro-conical weight to extend into corners of the spray container for maximizing the evacuation of the fluid contents contained in the spray container. Therefore, the flexible siphoning tube swings via gravitational forces, similar to a pendulum, in the direction of the flow of the fluid along an arc via an extendable frustro-conical weight. The extendable feature of such extendable frustro-conical weight allows the inlet port of the extendable frustro-conical weight to extend more deeply into the container beyond the line defined by the arc.

12 Claims, 3 Drawing Sheets

SPRAY CONTAINER HAVING AN EXTENDABLE FRUSTRO-CONICAL WEIGHT COUPLED TO THE SIPHONING TUBE

TECHNICAL FIELD

The present invention relates to spray containers having weighted siphoning tubes and, more particularly, to a spray container having an extendable frustro-conical weight coupled to the free end of a siphoning tube. The frustro-conical contour and the extendable properties of the extendable frustro-conical weight allows the extendable frustro-conical weight to extend into corners of the spray container for maximizing the evacuation of the fluid contents contained in the spray container. Therefore, the flexible siphoning tube swings via gravitational forces, similar to a pendulum, in the direction of the flow of the fluid along an arc via an extendable frustro-conical weight. The extendable feature of such extendable frustro-conical weight allows the inlet port of the extendable frustro-conical weight to extend more deeply into the container beyond the line defined by such arc.

BACKGROUND OF THE INVENTION

Several aerosol or spray-type containers have siphoning tubes. However, when the fluid level of the fluid stored in the containers becomes low and the container is tilted, the siphoning tube may not come in contact with the fluid, especially, when the fluid level is very low. Therefore, the contents contained in the containers are wasted because the siphoning tube cannot reach all the fluid to fully evacuate the contents in the container. As a result several containers incorporate a weight coupled to the siphoning tube to move the siphoning tube under gravitational forces to the fluid, such as, when the container is tilted.

For example, U.S. Pat. No. 5,636,770, to Hachinohe et al., entitled "AEROSOL DIP TUBE" discloses a dip tube whose tip portion can reach the nooks at the bottom of an aerosol container, so that the aerosol content therein can be assuredly sprayed with substantially no aerosol content being left unused. The disclosed weight is fixed around the dip tube and is arranged so that it does not hit the inner surface of the aerosol container.

U.S. Pat. No. 5,215,227, to Farner, entitled "ASSAILANT MARKER" discloses a device which includes a spray pump having a tube with a weight coupled thereto.

U.S. Pat. No. 4,940,152, to Lin, entitled "NURSING BOTTLE" discloses an easy-suck nursing bottle. There is provided a flexible internal suction pipe communicating with a weight and a float permitting the bottom end of the pipe to float on the liquid surface by the float. There is an opening at the bottom end of the pipe to be maintained constantly at slightly below the liquid surface so that liquid can always be sucked from around the surface of the liquid in the bottle. The weight has a section which is outwardly projecting, vertically through a plastic pipe connector formed integrally inside the passage hole thereof and a side suction hole so as to facilitate insertion of the weight element in the terminal end of the suction pipe and to maintain the suction opening behind the terminal end of the suction pipe to be always placed slightly below the liquid surface at the bottom side of the float.

U.S. Pat. No. 4,830,235, to Miller, entitled "SIPHON TUBE APPARATUS" discloses a siphon tube apparatus having a weighted pickup end formed with positioning legs to bias the pickup end of the articulated tube to the remote portions of the reservoir bottle to enable a more complete withdrawal and efficient use of fluid within the bottle. The disclosed weight is hemispherically shaped and has a pickup conduit formed therein for the passage of fluid therethrough.

U.S. Pat. No. 3,580,430, to Angele, entitled "AEROSOL CONTAINERS" discloses a long plunger tube with a free end weighted by a cup and a ball carried thereon, the ball being embraced in fluid tight manner by the cup with formation of a void therebetween communicating on the one hand with the bore of the tube and on the other hand with the interior of the container via one or more passages in the cup. The cup is provided with a marble.

U.S. Pat. No. 3,547,296, to Greenberg, entitled "NURSING BOTTLE DRINKING TUBE" discloses a tube member extending substantially to the bottom of the bottle and a weighted base member secured to the free end of the tube.

While each of the above containers with weighted siphoning tubes function as desired, none of them have an extendable frustro-conical weight coupled to the free end of a siphoning tube wherein the frustro-conical contour and the extendable properties of the extendable frustro-conical weight allows the extendable frustro-conical weight to extend into corners of the spray container for maximizing the evacuation of the fluid contents contained in the spray container. Moreover, the above do not disclose that the flexible siphoning tube swings via gravitational forces, similar to a pendulum, in the direction of the flow of the fluid along an arc via an extendable frustro-conical weight wherein the extendable feature of such extendable frustro-conical weight allows the inlet port of the extendable frustro-conical weight to extend more deeply into the corners of the container beyond the line defined by such arc.

SUMMARY OF THE INVENTION

The preferred embodiment of the spray container of the present invention solves the aforementioned problems in a straight forward and simple manner. What is provided is a spray container having an extendable frustro-conical weight coupled to the free end of a siphoning tube. The frustro-conical contour and the extendable properties of the extendable frustro-conical weight allows the extendable frustro-conical weight to extend into corners of the spray container for maximizing the evacuation of the fluid contents contained in the spray container. Therefore, the flexible siphoning tube swings via gravitational forces, similar to a pendulum, in the direction of the flow of the fluid along an arc via an extendable frustro-conical weight. The extendable feature of such extendable frustro-conical weight allows the inlet port of the extendable frustro-conical weight to extend more deeply into the container beyond the line defined by such arc.

The container of the present invention comprises: a fluid container member having fluid therein; means for siphoning said fluid coupled to said fluid container member; a siphoning tube coupled to said siphoning means wherein said siphoning tube provides a conduit for delivering said fluid to said means for siphoning; and, a frustro-conical weight couplable to said siphoning tube.

The frustro-conical weight comprises: a weight member having a frustro-conical contour defined by a base having a first diameter and a conically tapering surface which ends to define a second diameter wherein a center of said weight member has formed therein a hollow passage which extends the length of said weight member to form an inlet port; and a weight connector having a hollow center wherein said weight connector has one end connectable to a free end of said siphoning tube and another end couplable to said weight member.

In view of the above, an object of the present invention is to provide a spray container having a flexible siphoning tube having coupled to its free end an extendable frustro-conical weight for positioning the flexible siphoning tube in the fluid. The weight of the extendable frustro-conical weight having gravitational forces acting thereon directs the flexible siphoning tube in the direction of the flow of the fluid which is particularly advantageous when the fluid level is low.

More specifically, the primary objective of the present invention is to provide a siphoning tube with a weighted end so that the inlet port into the siphoning tube is positioned in the fluid regardless of the orientation of the container, especially, when the fluid level is low. Therefore, as gravitational forces direct the fluid into a particular area within the container as the orientation of the container is changed, the same such gravitational forces acting on the fluid acts on the extendable frustro-conical weight so that the inlet port formed in the extendable frustro-conical weight follows the fluid flow. Henceforth, as the fluid level decreases and as the orientation of the container is changed from other than an upright position, the fluid can be siphoned from the area in which the fluid collects.

Another object of the present invention is to provide an extendable frustro-conical weight which is coupled to the flexible siphoning tube via a slide shaft having a hollow interior to enable the inlet port of the extendable frustro-conical weight to be extended more deeply into a corner of the container as the spray container is tilted.

A further object of the present invention is to provide such an extendable frustro-conical weight having a frustro-conical contour which is defined by a cone shaped structure having a truncated peak. The frustro-conical contour provides a sufficient weight to obtain the desired objectives while minimizing the overall surface area so that the frustro-conical weight does not occupy a sufficient amount of volume within the container. As a result, the amount of contents purchased by the consumer is not significantly diminished. Additionally, the tapered ends of the frustro-conical contour produce an exterior perimeter which can be extended more deeply into the corner of the container.

It is a still further object of the present invention to alternately provide a very flexible siphoning tube wherein the very flexible properties of the very flexible siphoning tube would allow the weight to bend and direct the very flexible siphoning tube in the direction of the fluid flow when the spray container is turned up-side down.

In view of the above objects, it is a feature of the present invention to provide a spray container which is simple to manufacture and use.

Another feature of the present invention is to provide an extendable frustro-conical weight which is relatively simple structurally.

The above and other objects and features of the present invention will become apparent from the drawings, the description given herein, and the appended claims.

BRIEF DESCRIPTION OF DRAWINGS

For a further understanding of the nature and objects of the present invention, reference should be had to the following detailed description, taken in conjunction with the accompanying drawings, in which like elements are given the same or analogous reference numbers and wherein.

DESCRIPTION OF THE EXEMPLARY EMBODIMENT

Figure 1:
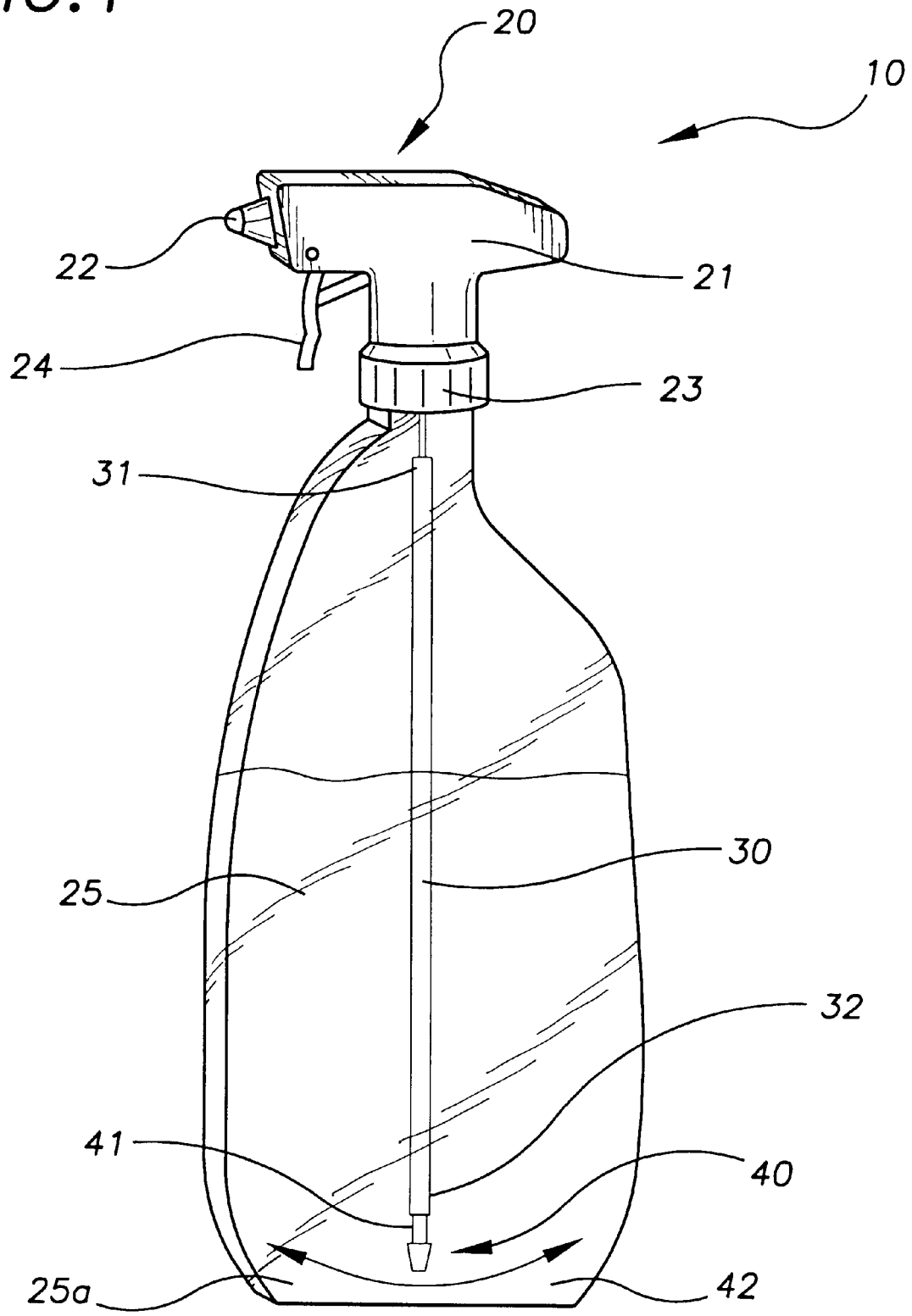
FIG. 1 illustrates a perspective view of the preferred embodiment of the spray container having the extendable frustro-conical weight coupled to the siphoning tube of the present invention.
Figure 2:
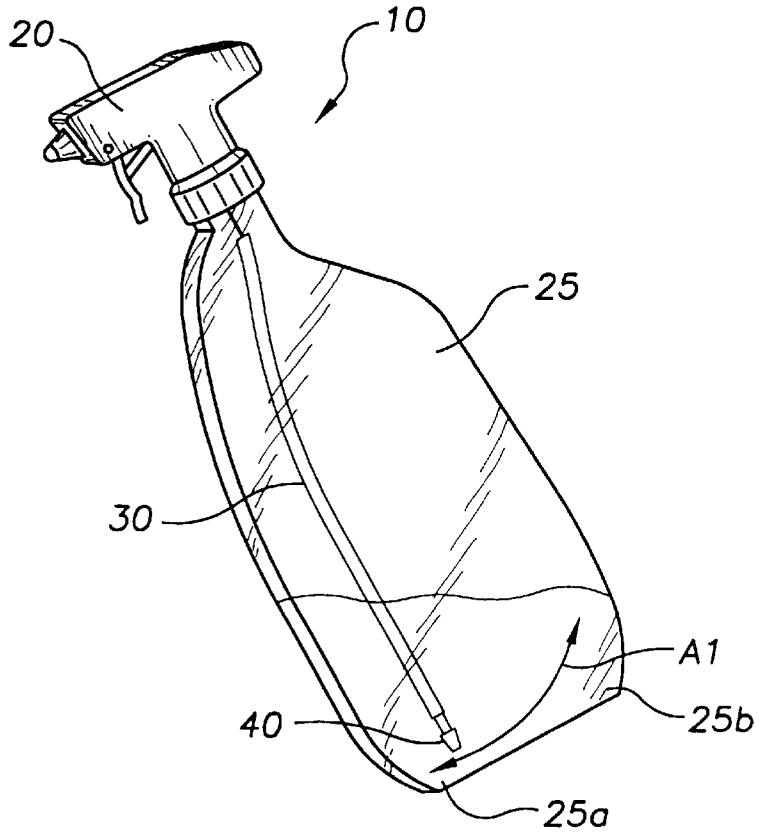
FIG. 2 illustrates the spray container in a tilted orientation.

Referring now to the drawings, and in particular FIGS. 1–2, the spray container of the present invention is designated generally by the numeral 10. Spray container 10 is comprised of siphoning means 20, fluid container 25, flexible siphoning tube 30, and extendable frustro-conical weight 40.

Siphoning means 20 comprises spray pump member 21 having spray outlet means 22. Spray pump member 21 is coupled to fluid container 25 via threaded screw cap 23. In the exemplary embodiment, spray pump member 21 comprises squeeze release member 24 which siphons fluid up through flexible siphoning tube 30 when actuated. Alternately, siphoning means 20 may comprise a nipple such as for baby bottles which can be sucked to siphon fluid through flexible siphoning tube 30. Furthermore, spray container 10 may be an aerosol container which dispenses pressurized fluid.

Flexible siphoning tube 30 is an elongated tube which has one end 31 coupled to siphoning means 20 and the other end 32, is hereinafter referred to as the "free end", is disposed in the bottom portion of fluid container 25. The length of the elongated tube may vary depending of the depth of fluid container 25.

In the preferred embodiment, flexible siphoning tube 30 is made of plastic.

Figure 3:
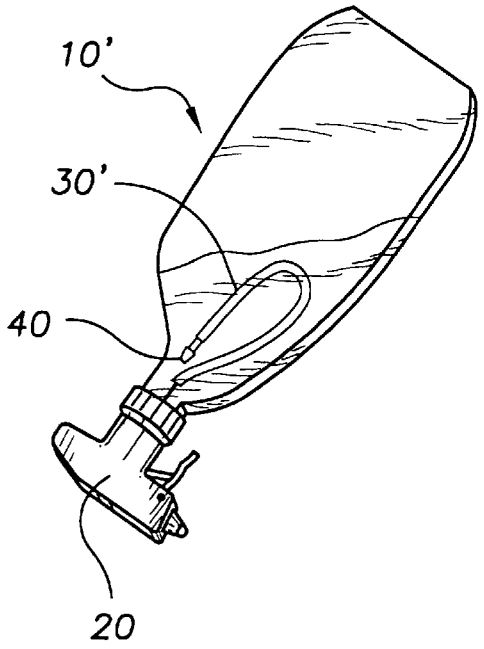
FIG. 3 illustrates an alternate embodiment of the siphoning tube of the spray container having very flexible properties for use in a somewhat up-side down orientation.

Referring to FIG. 3, flexible siphoning tube 30' may be made very flexible wherein the very flexible properties of the very flexible siphoning tube 30' would allow the weight of extendable frustro-conical weight 40 to bend and direct very flexible siphoning tube 30' in the direction of the fluid flow when spray container 10' is turned up-side down.

Figure 4:
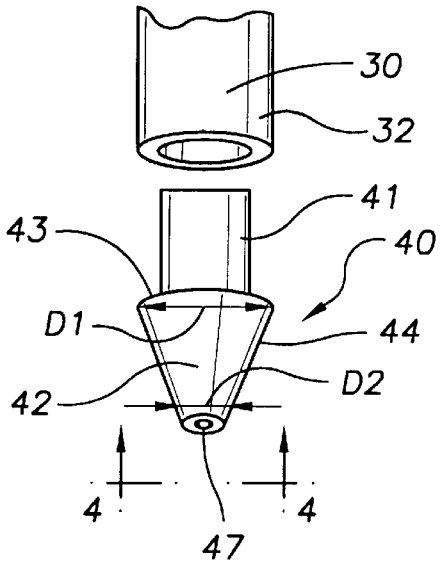
FIG. 4 illustrates the extendable frustro-conical weight of the present invention.
Figure 5A:
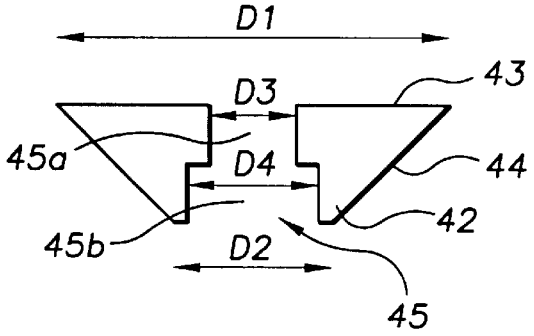
FIG. 5*a* illustrates a cross-sectional view along the plane of 4—4 of FIG. 4 of the weight member of the extendable frustro-conical weight of the present invention.
Figure 5B:
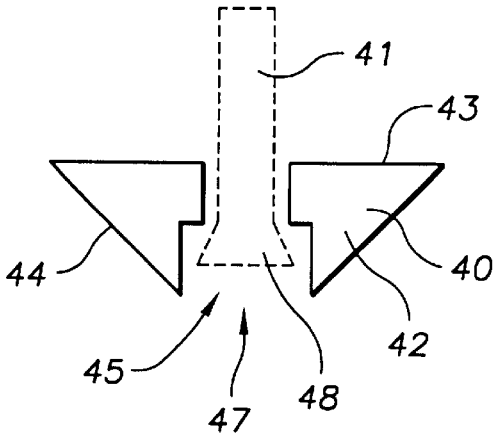
FIG. 5*b* illustrates a cross-sectional view along the plane of 4—4 of FIG. 4 of weight member and weight connector of the extendable frustro-conical weight of the present invention.

Referring also to FIGS. 4 and 5*a*–5*b*, extendable frustro-conical weight 40 comprises weight connector member 41 and weight member 42. Weight member 42 has base 43 having first diameter D1 and conically tapering surface 44 which ends to define second diameter D2. Weight member 42 has formed in the center thereof hollow passage 45 wherein as conically tapering surface 44 ends inlet port 47 is formed.

The frustro-conical contour of weight member 42 is defined by a cone shaped structure having a truncated peak. The frustro-conical contour provides a sufficient weight to obtain the desired objectives while minimizing the overall surface area of weight member 42 so that extendable frustro-conical weight 40 does not occupy a sufficient amount of volume within fluid container 25. Additionally, conically tapering surface 44 of the frustro-conical contour produces an exterior perimeter which can be extended unhindered into corners 25*a* and 25*b* of fluid container 25. Therefore, conically tapering surface 45 allows inlet port 47 of extendable frustro-conical weight 40 to be received in corners 25*a* and 25*b* of fluid container 25.

Hollow passage 45 comprises first passage section 45*a* having first passage diameter D3 and second passage section 45*b* having second passage diameter D4 wherein the center axis of first passage section 45*a* is the center axis of second passage section 45*b*. Furthermore, the center axis of first passage section 45*a* and second passage section 45*b* is the same as the center axis of flexible siphoning tube 30. Hollow passage 45 extends the length of weight member 42 to form inlet port 47 of extendable frustro-conical weight 40. First passage diameter D3 is smaller than second passage diameter D4.

Weight connector member 41 has one end friction fit coupled in a fluid tight manner to the free end of flexible siphoning tube 30. Weight connector member 41 has a cylindrical contour with a hollow center to permit the flow of fluid therethrough inlet port 47 into the hollow center of weight connector member 41 and up through flexible siphoning tube 30.

The other end of weight connector member 41 is a flared end, herein after referred to as "flared end 48". Flared end 48 is dimensioned to slide within second passage section 45*b* and the length of weight connector member 41 slidably supports weight member 42 thereon wherein the diameter of weight connector member 41 is capable of sliding within first passage section 45*a*.

Flared end 48 prevents weight member 42 of extendable frustro-conical weight 40 from sliding off of weight connector member 41. The cylindrical contour of weight connector member 41 functions as a slide shaft for weight member 42 so that weight member 42 can slidably extend beyond the line defined by arc A1. As can be appreciated, as weight member 42 slides on the slide shaft, the depth of extendable frustro-conical weight 40 is adjusted. Therefore, inlet port 47 of extendable frustro-conical weight 40 is capable of being extended more deeply into corners 25*a* and 25*b* of fluid container 25 as fluid container 25 is tilted. Thereby, as the fluid level within fluid container 25 decreases to a very low level and as the orientation of fluid container 25 changes, extendable frustro-conical weight 40 slides along weight connector member 41 to further extend inlet port 47 into the fluid pool.

In operation, flexible siphoning tube 30 swings via gravitational forces, similar to a pendulum, in the direction of the flow of the fluid along arc A1 via extendable frustro-conical weight 40, as the orientation of fluid container 25 is changed. The extendable feature of extendable frustro-conical weight 40 allows inlet port 47 of extendable frustro-conical weight 40 to extend more deeply into corners 25*a* and 25*b* of fluid container 25 beyond the line defined by arc A1. Henceforth, the fluid in fluid container 25 is capable of being siphoned up through flexible siphoning tube 30 even if the fluid level is very low.

The arc line of arc A1 is defined by inlet port 47 when extendable frustro-conical weight 40 is not is a fully extended position. As the fluid level decreases, the extendable frustro-conical weight 40 is capable of extending further in fluid container 25 as flexible siphoning tube 30 swings from side-to-side.

It is noted that the embodiment of the spray container described herein in detail, for exemplary purposes, is of course subject to many different variations in structure, design, application and methodology. Because many varying and different embodiments may be made within the scope of the inventive concept(s) herein taught, and because many modifications may be made in the embodiment herein detailed in accordance with the descriptive requirements of the law, it is to be understood that the details herein are to be interpreted as illustrative and not in a limiting sense.

What is claimed is:

1. A spray container comprising:

a fluid container member having fluid therein;

means for siphoning said fluid coupled to said fluid container member;

a siphoning tube coupled to said siphoning means wherein said siphoning tube provides a conduit for delivering said fluid to said means for siphoning; and, an extendable frustro-conical weight couplable to said siphoning tube wherein said frustro-conical weight comprises:

a weight member having a frustro-conical contour defined by a base having a first diameter and a conically tapering surface which ends to define a second diameter wherein a center of said weight member has formed therein a hollow passage which extends the length of said weight member to form an inlet port, and a weight connector having a hollow center wherein said weight connector has one end connectable to a free end of said siphoning tube and another end couplable to said weight member;

said hollow passage of said weight member comprising a first passage section having a first passage diameter and a second passage section having a second passage diameter wherein a center axis of said first passage section is the center axis of the second passage section and said first passage diameter is smaller than said second passage diameter; said weight connector having a cylindrical contour and being slidable coupled in said first passage section and said other end of said weight connector being flared wherein the flared end is slidable in said second passage section to extend a depth of said weight member.

2. The spray container of claim 1, wherein said weight connector is friction fit coupled in said free end of said siphoning tube.

3. The spray container of claim 1, wherein said siphoning tube is flexible and flexes in the direction of the movement of said frustro-conical weight.

4. The spray container of claim 1, wherein said siphoning tube is capable of swinging along an arc and said frustro-conical weight is extendable to extend said inlet port of the weight member deeply into corners of said fluid container member beyond a line defined by said arc.

5. A container comprising:

a fluid container member having fluid therein;

means for siphoning said fluid coupled to said fluid container member;

a siphoning tube coupled to said siphoning means wherein said siphoning tube provides a conduit for delivering said fluid to said means for siphoning; and, an extendable frustro-conical weight couplable to said siphoning tube wherein said frustro-conical weight comprises:

a weight member having a frustro-conical contour defined by a base having a first diameter and a conically tapering surface which ends to define a second diameter wherein a center of said weight member has formed therein a hollow passage which extends the length of said weight member to form an inlet port, and a weight connector having a hollow center and is slidable coupled to said weight member wherein said weight connector has one end connectable to a free end of said siphoning tube;

said hollow passage of said weight member comprises a first passage section having a first passage diameter and a second passage section having a second passage diameter wherein a center axis of said first passage section is the center axis of the second passage section and said first passage diameter is smaller than said second passage diameter;

said weight connector has a cylindrical contour and is slidable coupled in said first passage section and said other end of said weight connector is flared wherein the flared end is slidable in said second passage section to extend a depth of said weight member.

6. The spray container of claim 5, wherein said weight connector is friction fit coupled in said free end of said siphoning tube.

7. The spray container of claim 5, wherein said siphoning tube is flexible and flexes in the direction of the movement of said frustro-conical weight.

8. The spray container of claim 5, wherein said siphoning tube is capable of swinging along an arc and said frustro-conical weight is extendable to extend said inlet port of the weight member deeply into corners of said fluid container member beyond a line defined by said arc.

9. A container comprising:

a fluid container member having fluid therein;

means for siphoning said fluid coupled to said fluid container member;

a siphoning tube coupled to said siphoning means wherein said siphoning tube provides a conduit for delivering said fluid to said means for siphoning; and, an extendable frustro-conical weight couplable to said siphoning tube wherein said frustro-conical weight comprises:

a weight member having a frustro-conical contour defined by a base having a first diameter and a conically tapering surface which ends to define a second diameter wherein a center of said weight member has formed therein a hollow passage which extends the length of said weight member to form an inlet port wherein said hollow passage of said weight member comprises a first passage section having a first passage diameter and a second passage section having a second passage diameter wherein a center axis of said first passage section is the center axis of the second passage section and said first passage diameter is smaller than said second passage diameter, and a weight connector having a hollow center and is slidable coupled to said weight member wherein said weight connector has one end connectable to a free end of said siphoning tube and wherein said weight connector has a cylindrical contour and is slidable coupled in said first passage section and said other end of said weight connector is flared wherein the flared end is slidable in said second passage section to extend a depth of said weight member.

10. The spray container of claim 9, wherein said weight connector is friction fit coupled in said free end of said siphoning tube.

11. The spray container of claim 9, wherein said siphoning tube is flexible and flexes in the direction of the movement of said frustro-conical weight.

12. The spray container of claim 9, wherein said siphoning tube is capable of swinging along an arc and said frustro-conical weight is extendable to extend said inlet port of the weight member deeply into corners of said fluid container member beyond a line defined by said arc.

* * * * *